United States Patent [19]

Lemelson

[11] 4,251,311

[45] Feb. 17, 1981

[54] BUTTON ASSEMBLY APPARATUS

[76] Inventor: Jerome H. Lemelson, 85 Rector St., Metuchen, N.J. 08840

[21] Appl. No.: 950,016

[22] Filed: Oct. 10, 1978

Related U.S. Application Data

[63] Continuation-in-part of Ser. No. 729,959, Oct. 6, 1976, Pat. No. 4,120,054.

[51] Int. Cl.[3] ..... B32B 19/02; B32B 7/08; D05B 3/16

[52] U.S. Cl. ..... 156/380; 2/265; 156/93; 156/583.8

[58] Field of Search ..... 156/92, 93, 252, 380, 156/583.8; 2/265; 112/408, 110

[56] References Cited

U.S. PATENT DOCUMENTS

| | | | |
|---|---|---|---|
| 3,040,153 | 6/1962 | Seney | 156/380 |
| 3,464,102 | 9/1969 | Soloff | 156/380 |
| 3,816,200 | 6/1974 | McKenna | 156/93 |

*Primary Examiner*—Douglas J. Drummond

[57] ABSTRACT

Structures are provided in attachment means for textile fasteners such as buttons and the like. In one form, a flexible thread or filament is secured between a fastener such as a button and textile material and is reinforced by means of a plastic material. A plurality of loops of the thread are secured together with a plastic which not only reinforces the thread but also serves to prevent its unwinding from the textile material and fastener. The reinforcing plastic may also be bonded or welded to the fastener and the textile material. In another form, the thread or filament is coated with or comprises a heat sealable plastic wherein a specially heated tool is employed to seal same to itself and in certain instances the fastener and the textile material.

8 Claims, 6 Drawing Figures

BUTTON ASSEMBLY APPARATUS

RELATED APPLICATIONS

This is a continuation-in-part of Ser. No. 729,959 filed Oct. 6, 1976, now U.S. Pat. No. 4,120,054.

SUMMARY OF THE INVENTION

This invention relates to improvements in securing and retaining fasteners such as buttons to textile materials such as articles of clothing. In particular, the invention is concerned with improvements in the structures of and methods for securing fasteners to textile material so as to strengthen the fastening, prevent its unwinding and breakage during use.

Accordingly, it is a primary object of this invention to provide new and improved fastening means and methods for securing fasteners such as buttons to textile material.

Another object is to provide an improved method of fastening a button to a textile material in a manner to substantially enhance the strength of the fastening and increase its longevity.

Another object is to provide a new and improved tool applicable for improving the strength and longevity of button fastenings.

Another object is to provide a button fastening structure which is not susceptible to fraying during use.

With the above and such other objects in view as will more fully appear from the accompanying specification and drawings, the invention consists of the novel constructions and methods disclosed but it is to be understood that changes and modifications may be resorted to which come within the purview of the invention as claimed.

Figure 1:
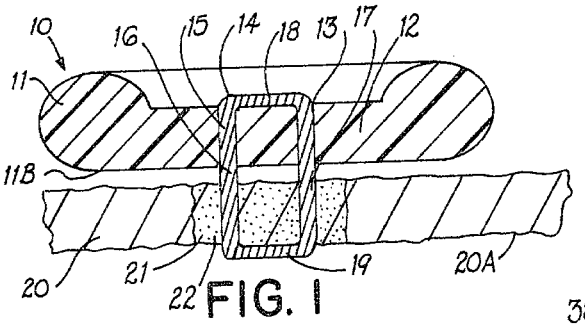
FIG. 1 is a cross sectional view of a button fastener and a textile material showing details of an improved fastening means for securing the button to the textile material.

In FIG. 1 is shown a first form of the invention comprising an assembly 10 formed of a section or assembly 20 of textile material, a portion of which is illustrated as having a plastic or metal button 11 secured thereto by means of a sewn thread or filament 14 which is shown looped through a plurality of holes 13 extending through the central portion 12 of the button 11. Conventional sewing and tieing means for the thread 14 may be employed to define same as one or more loops having portions 15 thereof extending through the holes 13 in the button, portions 16 and 17 extending respectively between the button and material 20 through spaced-apart openings formed in the textile material 20 by a sewing or fastening needle and portions 18 and 19 respectively extending across the top surface of the central portion 12 of the button and beneath or across the underside of the textile material 20. While only one loop of textile material is shown in FIG. 1 as extending between two holes in the button, a plurality of such loops may be provided closely adjacent to each other and crossing over the top surface of the button so as to extend between three, four or more holes in the button and respective holes through the textile material.

The textile material 20 may be composed of any suitable synthetic or natural fiber such as cotton, wool, cellulose acetate, Rayon, polyester, polyamide, Nylon, etc. It is preferably a porous knit, woven or non-woven cloth capable of impregnation with a reinforcing plastic material.

Impregnating a portion 21 of the textile material 20 in the immediate vicinity of the portions 16, 17, etc., of the yarn or thread 14 which is used to fasten the button 11 to the cloth 20, is a quantity 22 of plastic resin which serves a number of important purposes. Firstly, the impregnating resin quantity 22 serves to reinforce the fibers or yarn of the cloth 20 where tension forces are greatest due to the pulling action thereon, caused while the button 11 is functioning to retain the section of textile material 20 illustrated in assembly with itself or with another section thereof defining a garment such as a blouse, shirt, skirt, pants, sweater, jacket, coat or other article. The resin 22 may thus be provided to prevent or delay the destruction of textile material in the vicinity of the portion 21 surrounding the fastening thread or yarn 14.

The resin 22 impregnating portion 21 of the textile material 20 also serves to prevent longitudinal unthreading movement of the thread or yarn 14 as the plurality of loop formations thereof extend through the resin impregnated portion 21 of the textile material and are adhesively bonded thereto, so that if one or more portions of said yarn become frayed or cut during use, the remaining portions will not pull out of the holes in the button and cloth 20.

The resin 22 impregnating portion 21 may also impregnate all or the remaining portions of the thread or yarn 14 extending through and around button 11 and may also be disposed between the portion 18 thereof and the top surface of the central portion 12 of the button to bond said thread or yarn to the button itself to further enhance the securing action. Such resins as plasticized polyvinyl chloride, polyethylene, polypropylene, ethylene vinyl acetate, polybutadiene styrene, ionomer, polyamide, polyester and other resins may be applied to the portion 21 of the textile material during, just prior to or immediately after the sewing action to bond the thread-like element 14 to the textile material 20 as described. The resin may be applied in a hot melt condition by injection into the pores of the portion 21 or by pressure contact of an applicator having a tip portion which applicator applies a small quantity or drop of said resin, preferably as pressure is applied to one surface of the textile material 20 while the other surface thereof is engaged against a backing surface to effect a forced impregnation of the pores or cells of portion 21. The resin may also be applied to the underside 11B of the button and transferred therefrom to the portion 21 during or immediately after sewing the button in place.

Figure 2:
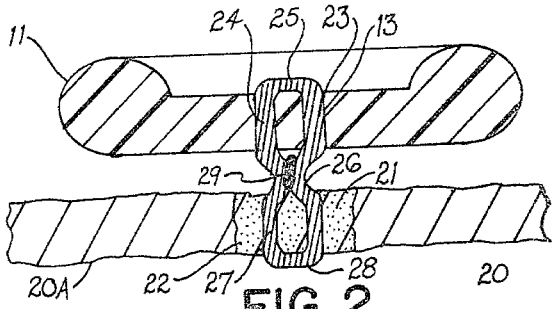
FIG. 2 is a cross sectional view of a button fastener and a portion of textile material showing a modified form of improved fastening means for securing the button to the textile material.

In a second form of the invention illustrated in FIG. 2, a button fastener 11 is shown secured to a section of textile material 20 of the type described. A textile thread, yarn or filament 23 is shown looped a number of times through a plurality of holes 13 in the central portion of the button 11 and through a plurality of holes extending through a portion 21 of the textile material. The thread or yarn 23 contains portions 24 thereof extending through the holes 13, portions 26 extending between the button and the cloth 20, and portions 27 extending through the cloth 20 with one or more loop formations 28 joining the portions 27 against the inside face of the textile material 20. Joining portions 25 of the thread 23 extend along the outer face of the button 11.

The textile thread, yarn or filamentary material 23 is preferably either made of a heat sealable plastic resin such as one or more filaments of polyethylene, polypropylene, polyvinyl chloride, polyamide or other suitable resin or is impregnated or coated with said resin so that the portions 26 of said thread or filamentary material which extend between the button and the textile material 20 may be adhesively bonded, heat sealed or electronically sealed together to serve a number of important purposes. Firstly, by bonding or sealing the portions 26 together, an increase in tensile strength of the entire sewn formation of thread is effected. Longitudinal movement of the thread or filamentary material 23 is restricted and prevented should any particular portion thereof become frayed, stretch or break. Furthermore, fraying due to friction and wear is reduced if not eliminated by the resin impregnating or coating or forming the thread material 23. Finally it is noted that by employing a heat sealable resin for the thread 23 or by impregnating or coating same thereon, the heat sealing or bonding material may extend between the outer portions 25 of the thread and the material of the button 11 itself or a material coated on same to further enhance the fastening action, protect the thread-like material against stretching and breakage and against fraying. Notation 29 in FIG. 2 refers to a spot bond, heat or electronic seal between adjacent portions of the portions 26 of the thread material 24 extending between the button and textile material 20, which sealing may be effected by one of the means illustrated in FIGS. 3 and 4. Also shown in FIG. 2 is the portion 21 surrounding the portions 27 of thread-like material extending through the textile material 20, and it is noted that as an auxiliary enhancement of the fastening means, the portion 21 may contain a reinforcing and bonding resin of the type provided in the assembly 10 of FIG. 1.

Figure 3:
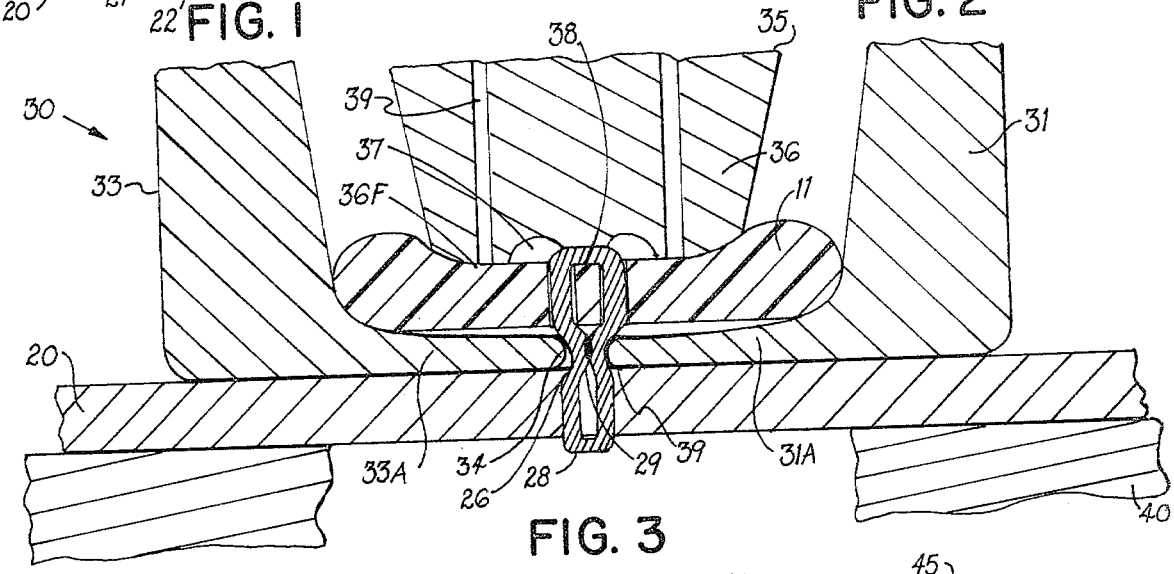
FIG. 3 is a side cross sectional view of a button and fastening material of the type shown in FIG. 2 together with the operating parts of a heat sealing or welding tool for performing a welding operation on the thread securing the button to the textile material.
Figure 5:
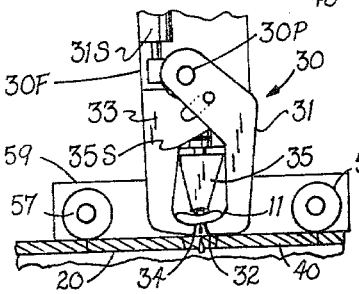
FIG. 5 is a side view of part of a tool of the type shown in FIG. 3 as it operates on a button fastener assembly, it being noted that the components thereof may also be applied to the apparatus of FIG. 4 with certain hidden modifications thereto.

In FIG. 3 is shown an apparatus 30 for effecting a welding operation with respect to the fastening threads or filaments provided between a button 11 and a section of textile material 20. The apparatus 30 is shown as composed of a table 40 and respective cooperating L-shaped or otherwise configured die elements 31 and 33 having respective die end portions 31A and 33A of narrow configuration which are adapted to be manually or automatically moved between the button 11 and the textile material 20 so as to dispose the welding tip portions 32 and 34 of each die member against opposite sides of the bundle or portions 26 of the fastening thread or filamentary material 23 extending between the button and the textile material. The die members 31 and 33 are preferably pivotally supported on a common mount, as illustrated in FIG. 5, and are power operated by a solenoid, motor or fluid actuator to be pivoted to the operating position illustrated in FIG. 3 whereby the tip portions 32 and 34 surrounding and compress the bundle of formations 26 together and, either by applying suitable heat or radio frequency energy across the tip portions, to serve to weld or bond the resinous material of the fastening material 23 together to form the bonded or weld formation 29 described in FIG. 2.

Also shown in FIG. 3 is a central portion or member 35, preferably forming part of the welding tool 30, which contains an operating head 36, the end of which is shown engaging the top side of the button 11. Working head 36 is preferably movable by means of a motor, solenoid or other form of lineal actuator, on the same mount supporting the dies 31 and 33 in a direction normal to the textile material 20 and contains a plurality of passageways 39 extending therethrough in alignment with portions of the top surface of the button 11 which surround the holes in the button. When vacuum pressure is sequentially applied to the passageways 39, the button 11 is retained against the end face 36F of the head 36, and controlled movement of said head away from the textile material 20 may be effected to permit the end portions 31A and 33A of the dies 31 and 33 to be easily passed between the button and the textile material 20 so as to effect the described welding or bonding operation between the adjacent portions of the thread or filamentary material 26 extending between the button and the textile material. Notation 37 refers to a recessed cavity in the end face of the operating head 36 and 38 to a central portion of the operating head which may be utilized to engage a portion of the fastening thread or filamentary material extending across the top face of the button 11 and to bond or weld same to the button, if necessary.

It is noted that the operating head 36 may also contain a sewing needle which cooperates with a conventional automatic sewing means forming part of the table 40 against which the textile material 20 is disposed for simultaneously sewing the button in place just prior to welding or bonding the fastening thread or filamentary material to itself and/or to the button for the purposes described. It is also noted that the welding die members 31 and 33 may be shaped and adapted to effect a weld or bonding between those portions 27 of the fastening thread or filamentary material which extend through the textile material 20 and the textile material itself or a heat sealable plastic material impregnating that portion of the textile material immediately surrounding the fastening thread or filamentary material.

Figure 4:
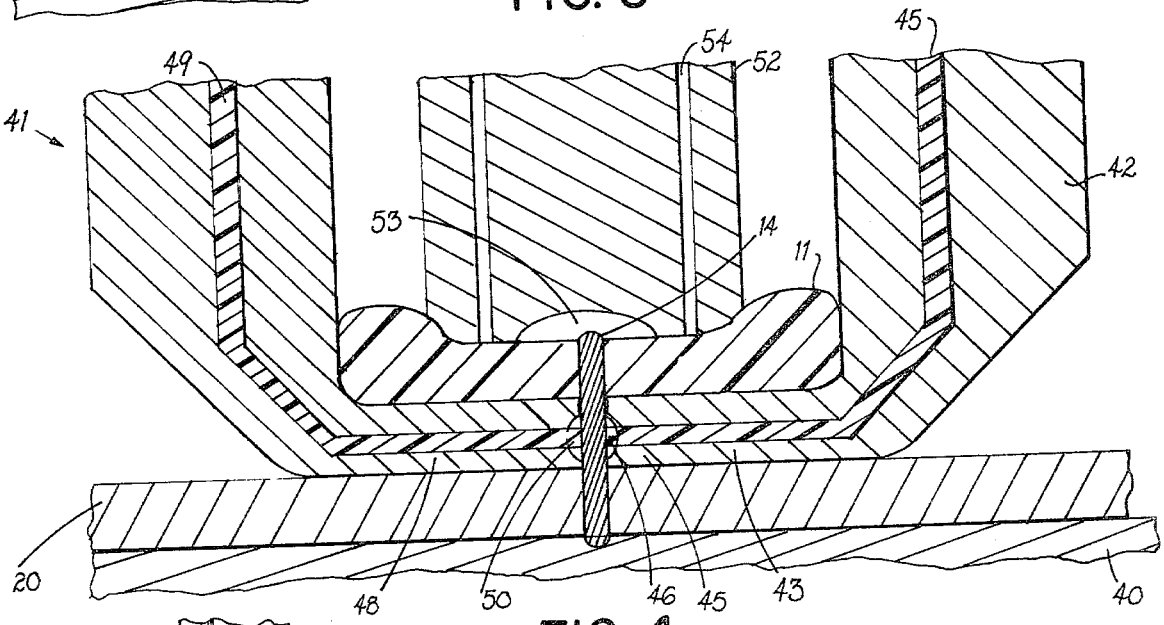
FIG. 4 is a side cross sectional view of a button and fastening material and the operating parts, also in cross section, of a tool which operates to apply a protecting and reinforcing plastic to the thread securing the button to the textile material and to one or bothe the button and textile material components.

In FIG. 4 is shown an apparatus 41 for effecting a bonding operation between adjacent portions of the thread, yarn or filamentary material 14 of the type described in FIG. 1 which extends between holes 13 in the button 11 and through openings in the textile material 20. The textile material 20 is shown disposed against a table 40 which may be part of a sewing machine or a portion of the apparatus 41. The apparatus 41 comprises cooperating tool members 42 and 47 which are preferably pivotally supported on a common support (not shown) and are adapted to cooperate with a centrally disposed retaining head 52, preferably also forming part of the apparatus 41, and utilized to engage the central portion of the button 11 and hold or pull same outwardly from the textile material 20 to permit the narrow end portions 43 and 48 of the tool members 42 and 47 to be moved beneath and between the button 11 and the textile material 20 so that the tip portions 44 and 48 of the tool members 42 and 47 may abut each other circumscribe, and compress the portions of the fastening thread 14 therebetween.

A passageway 45 extends through tool member 42 and a second passageway 49 through tool member 47, each of which passageways is connected through a valve (not shown) to a pressurized source of a liquid resinous material such as a hot melt resin or adhesive or an air drying adhesive which is force fed through the passageways to respective cavities 46 and 50 at the end of the tool tip portions 43 and 48 so as to be applied against and/or impregnate the portions of the fastening thread 14 between the button and the textile material. The adhesive or hot melt applied through the passageways 45 and 49 may also be applied by pulsing a solenoid or fluid actuator each time the tool members 42 and 47 are brought together against portions of thread material fastening a button to a textile material so as to apply such adhesive or hot melt resin as a bead-like formation to the adjacent portions of the thread and in certain instances to adjacent portions of the underside of the button and textile material 20. The liquid or molten adhesive may also be impregnated in a portion of textile material 20 immediately surrounding the fastening thread 14 to serve the purposes described above.

The working head 52 contains a cavity 53 in the central portion thereof immediately surrounding the portions of thread 14 which extend over the button and between the openings therein. Similar adhesive material may also be applied to the volume 53 through a passageway extending thereto to either bond the portions of thread extending against the outside surface of the button to the button itself or to cooperate with the adhesive material applied to the portions of thread 14 extending between the button and textile material. For such an embodiment, the adhesive applying tooling may merely comprise the working head 52 and the adhesive applied thereby may be applied merely to the central portion of the button and the portions of fastening thread 14 extending between the holes therein, or may be force fed through the holes in the button to the portions of thread extending between the button and textile material and flowed or injected into the textile material while the button is compressed thereagainst. The working head 52 may also contain a sewing needle which may be used in cooperation with a conventional automatic sewing mechanism forming part of the supporting base 40 and aligned with the needle to apply the textile thread 14 through the openings in the button. In yet another embodiment, the sewing needle may be hollow up to the end portion thereof containing the sewing thread and a suitable plastic resin, either in a molten or liquid air drying state, may be intermittently ejected through an opening in the needle as the needle passes through a button hole to apply a small quantity of the resin to the thread or button which resin solidifies thereafter against the thread to form one or more of the composite resin reinforced structures described herein.

In yet another form of the embodiments illustrated in FIGS. 3 and 4, it is noted that the buttons 11 may be made of thermoplastic material and may contain portions thereof which project either upwardly from the outer face of the button or beyond the underface of the button and which may be used to either retain a quantity of liquid or molten plastic resin which is applied to the button as described or applied thereto just prior to sewing the button to the garment or textile material and so located that the resin impregnates or coats at least a portion of the thread used to sew the button to the garment or even flows beyond the thread into the described selected portion 21 of the textile material aligned with the buttonholes and thread so as to coat or impregnate same during the button sewing operation.

In FIG. 5 is shown details of a tool 30 of the type illustrated in FIG. 3, which tool is supported on a mount secured to a working table 40 on the upper surface of which is retained a portion of textile material 20, such as a garment containing one or more buttons 11 which are secured thereto by one or more loop formations of thread as described. The table 40 may also comprise the working bed of a sewing machine wherein the tool 30 is supported by the inverted L-shaped working head of the sewing machine and includes or is supported adjacent the sewing needle mechanism thereof.

The die members 31 and 33 are shown joined at a pivot defined by a pin or shaft 30P and are moved apart and together in a pivoting action by means of a solenoid or motor 31S which is secured to the base or frame 30F which pivotally supports the jaws. Projection of the shaft of the solenoid 30S causes the jaws to open. When properly positioned adjacent a button and closed thereon, as shown, the jaw tips move beneath the button and against the thread sewn between the button and the garment 20 to effect the welding of the adjacent portions of the thread to each other and/or to the button, as described. Also shown in FIG. 5 is the tool head 35 disposed between the pivoted tool members 31 and 33 and supported by the shaft of a solenoid 35S which is secured to the main support 30F of the tool. Operation of the solenoid 35S and the application of suction pressure to the passageways of the tool head 35 may be utilized to hold and pull the button 11 away from the upper surface of the textile material 20 to permit the operating ends of the tool members or dies 31 and 33 to be positioned beneath the button and engage the sewing threads therebetween.

Also shown in FIG. 5 are a pair of wheels or rolls 57 and 58 which are supported on a frame 59 supported by the table 40 for engaging the textile material 20 or garment against the upper surface of table 40 to preposition and hold said textile material in place during the described welding operation effected by the tool 30. Thus it is noted that the components illustrated in FIG. 5 may be utilized to effect the automatic reinforcement of the button fastening means and/or the application of buttons to a garment or textile material. The frame 59 supporting the rolls 57 and 58 may also be operable per se and movable toward and away from the upper surface of table 40 to intermittently engage, hold and release textile material or garments against table 40 so as to preposition and retain same during the button applicating and thread reinforcing or fastening operations.

The components of the resin applicating tool 41 of FIG. 4 may also be constructed in accordance with the assembly and teachings of FIG. 5 wherein the adhesive or resin applicating devices or jaw members 42 and 47 are defined by the components 31 and 33 of FIG. 5.

It is also noted that a beam of welding radiation such as generated by a laser or electron gun may be employed to supplement or replace the dies of FIGS. 1-5 to weld the thread to itself and/or to the textile material or button. A laser or electron gun may be supported, for example, on or adjacent either of the dies 31 and 33 or 41,42 or similarly shaped holding and positioning devices for the button to either directly direct a beam of welding radiation against the thread disposed between the button and textile material and/or the portions thereof adjacent the button and textile material to weld the thread together and/or to the button or textile material. The beam may also be directed through a light pipe extending through a passageway in the die such as that used to flow adhesive in FIG. 4 or through a passageway in button holding devices 35 of FIG. 3 or 52 of FIG. 4 against the thread and button or through a hole in the button to the thread between the button and the textile material.

Figure 6:
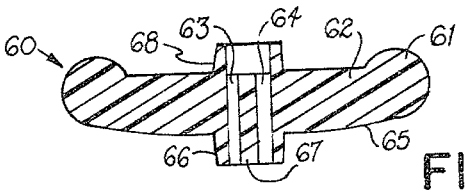
FIG. 6 is a cross-sectional side view of a button which may be attached by the apparatus of FIG. 5 to a garment.

FIG. 6 illustrates a modified form of plastic button which may be utilized as a garment component and applied by means of an apparatus of the type illustrated in FIG. 3. The button 60 is injection molded of a thermoplastic resin and includes a rim portion 61 and a central portion 62 containing a plurality of holes or passageways, two of which denoted 63 and 64, are shown extending completely through the central portion of the button. Protruding outwardly from the underside 65 of the button is a cylindrical formation 66 which circumscribes the peripheral portions of the holes 63 and 64. Disposed within the circular array of holes through the button is a pin-like protrusion 67. Thus, when thread is looped through the holes 63, 64, etc., and through the textile material to which the button is fastened, the protruding portions 66 and 67 respectively surround the outside and inside portions of the loop formations of thread. A welding tool of the type illustrated in FIG. 3 may be brought to bear against the cylindrical protruding portion 66 of the button and may be employed to heat and compress same inwardly against the loop formations of fastening thread extending between the button and the textile material. The tool may operate to render such cylindrical portion of thermoplastic material protruding from the underface of the button in a molten condition and cause it to flow around and through most of if not all of the thread extending between the button and textile material and perhaps even into the textile material as illustrated in FIG. 2. The resulting structure may be similar to that described wherein the reinforcing and bonding thermoplastic resin is applied to the button, the thread extending between the button and the textile material and perhaps even through the textile material itself. If the tips of the welding die are properly designed, the thermoplastic resin derived from the formation 66 of the button may be completely severed from the button or flowed in such a manner as to render the composite fastening flexible enough to permit the fastened button to be flexibly attached to the textile material.

Also shown in FIG. 6 is a cylindrical formation 68 of the material of the button protruding from the upper surface thereof and surrounding the holes 63, 64, etc., therethrough. The formation 68 may be engaged by an electrically energized or heated portion of the tool head 36 of FIG. 3, rendered thermoplastic and flowed inwardly and over the portions of the thread fastening material extending across the upper surface of the button so as to fusion bond said thread portions to the upper surface of the button for enhancing and improving the fastening operation as described. A thread so joined will not easily unthread or pull out of the garment and button.

In a final form of the invention, it is noted that the protruding formation 67 of FIG. 6 may extend a distance of $\frac{1}{8}''$–$\frac{1}{2}''$ or more beyond the underface 65 of the button and may be constructed flexible enough to permit it to be used in place of a thread for fastening the buttons to a substrate such as a garment or textile material. Such protruding formation of threadlike material may be injection molded of the same resin of which button 60 is molded or may be a more flexible resin which is molded in situ by so called double shot molding against the underface of the button. If the button 60 is made of nylon, extended formation 67 may also be made of the same nylon or a more flexible formulation of nylon, a polyester resin, or one of the above-described resins which may be passed through and heat sealed to the textile material or looped back through the textile material and heat sealed or otherwise fastened to itself or to the bottom face 65 of the button.

I claim:

1. An apparatus for reinforcing thread-like fastening means for a button fastener comprising in combination:

a support for a garment with a button threadably secured to said garment, said support having a garment with a button prepositioned by said garment with respect to said support, a plurality of cooperating dies prepositioned with respect to said support and disposed adjacent the button of said garment supported on said support, each of said dies having respective tip portions, and means for disposing said tip portions between said button and the surface of said garment to which said button is threadably secured, means for moving said dies toward and away from each other to permit said dies to engage the filamentary thread-like material joining said button to said garment therebetween, and means for energizing said dies while they are disposed close to each other to effect the welding together of said filamentary material disposed between said button and said garment in a manner to join said filamentary material to itself and prevent the longitudinal movement of said filamentary material between said button and said garment and to thereby prevent fraying and loosening of said filamentary material.

2. A device in accordance with claim 1 including means supported between said dies for prepositioning a button fastener with the dies movable beneath the button fastener against the thread-like material securing the button fastener to said garment.

3. A device in accordance with claim 2 including means disposed between said dies for sewing a button fastener disposed between said dies to said garment.

4. A device in accordance with claim 1 wherein said means for applying sealing energy to said dies comprises a radio frequency generator.

5. A device in accordance with claim 1 wherein at least one of said dies is pivotally supported for movement toward the other die.

6. A device in accordance with claim 1 wherein both of said dies are supported for pivotal movement and are moveable toward and away from each other.

7. A device in accordance with claim 1 including means disposed between said cooperating dies for holding a button fastener in position while said dies are moved beneath said button fastener and operated to engage and weld said filamentary thread-like material between the button and garment to which said button is fastened.

8. A device in accordance with claim 2 including means for flowing an adhesive material to the thread-like material while said button fastener is held by said means disposed between said cooperating dies.

* * * * *